US007326090B2

(12) United States Patent
Cayzac

(10) Patent No.: US 7,326,090 B2
(45) Date of Patent: Feb. 5, 2008

(54) FIXING DEVICE FOR TWO-PART CONNECTOR AND CORRESPONDING TWO-PART CONNECTOR

(75) Inventor: Gaspard Cayzac, Margut (FR)

(73) Assignee: Amphenol-Air LB, Colombes (FR)

( * ) Notice: Subject to any disclaimer, the term of this patent is extended or adjusted under 35 U.S.C. 154(b) by 63 days.

(21) Appl. No.: 11/449,394

(22) Filed: Jun. 8, 2006

(65) Prior Publication Data

US 2007/0143948 A1 Jun. 28, 2007

(30) Foreign Application Priority Data

Jun. 10, 2005 (FR) ..... 05 05894

(51) Int. Cl.
*H01R 13/64* (2006.01)

(52) U.S. Cl. ..... 439/680; 439/378; 439/677

(58) Field of Classification Search ..... 439/378, 439/668–677, 680, 681
See application file for complete search history.

(56) References Cited

U.S. PATENT DOCUMENTS 3,478,302 A 11/1969 Chirumbolo
3,594,698 A 7/1971 Anhalt
4,109,987 A 8/1978 Bourdon
4,349,241 A 9/1982 Juris et al.
4,615,578 A 10/1986 Stadler et al.
4,822,286 A 4/1989 Bianca et al.
5,437,563 A 8/1995 Kihira et al.
5,437,564 A 8/1995 Lignelet
5,718,592 A * 2/1998 Hosler et al. ..... 439/63
5,975,956 A 11/1999 Huguenet
6,059,600 A * 5/2000 Vanbesien ..... 439/378

(Continued)

FOREIGN PATENT DOCUMENTS

DE 10323616 8/2004

(Continued)

OTHER PUBLICATIONS

European Search Report for co-pending European Application Publication No. EP06290890, 1 page.
Search Report for French Application No. 055894, mailed Jan. 10, 2006, 1 page.
Search Report for French Application No. 055383, mailed Dec. 22, 2005, 1 page.
U. S. Patent and Trademark Office "Communication" for copending U.S. Appl. No. 11/441,919 mailed Apr. 5, 2007, available in PAIR.

*Primary Examiner*—James Harvey
(74) *Attorney, Agent, or Firm*—Meyertons, Hood, Kivlin, Kowert & Goetzel, P.C.; Eric B. Meyertons

(57) ABSTRACT

Fixing device for two-part connectors for connecting electrical conductors, the device comprising a first bush (12) and a second bush (14) adapted to be mounted in respective bores in the two connector parts, the first and second bushes comprising complementary means for removably fixing the first bush to the second bush, including polarizer means (24, 26) for authorizing cooperation of the fixing means in only one predetermined angular position of the first and second bushes, the device being characterized in that the removable fixing means are quarter-turn fixing means (43, 44).

16 Claims, 2 Drawing Sheets

U.S. PATENT DOCUMENTS

| | | | | |
|---|---|---|---|---|
| 6,135,818 | A | 10/2000 | Lang et al. | |
| 6,478,631 | B1 | 11/2002 | Dutton et al. | |
| 6,582,244 | B2 | 6/2003 | Fogg et al. | |
| 6,632,107 | B1 * | 10/2003 | Vanbesien | 439/680 |
| 6,705,894 | B1 | 3/2004 | Comerci et al. | |
| 6,926,562 | B1 | 8/2005 | Wu | |
| 2007/0032131 | A1 * | 2/2007 | Cayzac | 439/578 |
| 2007/0143948 | A1 * | 6/2007 | Cayzac | 15/250.34 |

FOREIGN PATENT DOCUMENTS

| | | |
|---|---|---|
| EP | 0237383 | 9/1987 |
| EP | 0416769 | 3/1991 |
| GB | 2282920 | 10/1993 |

* cited by examiner

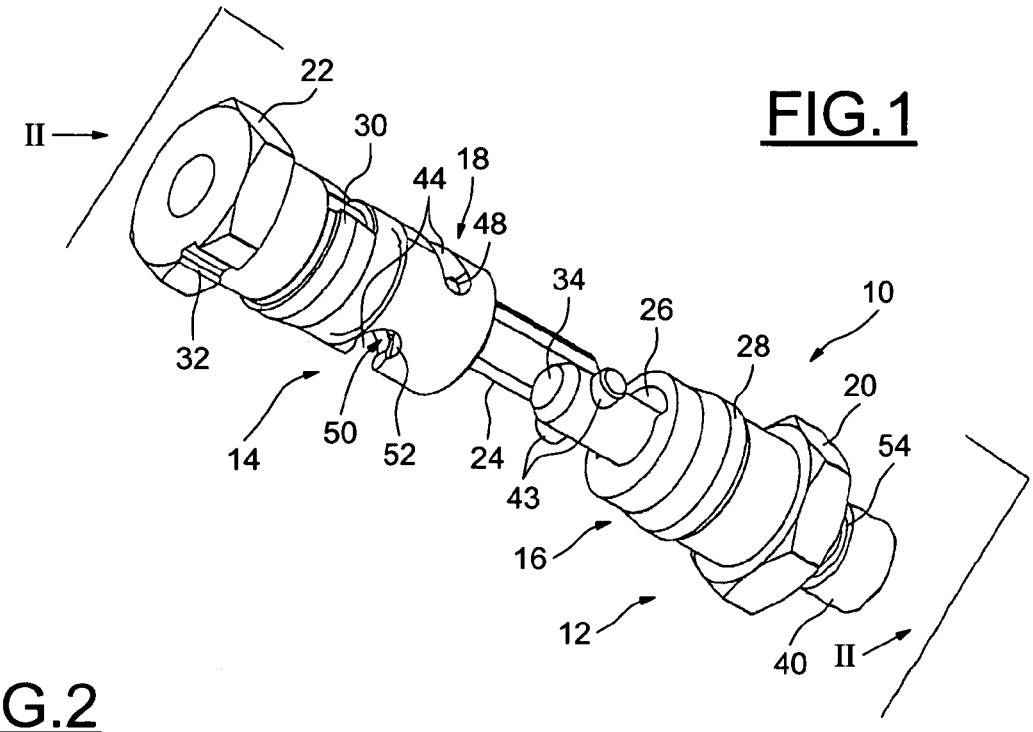
FIG.1
FIG.2
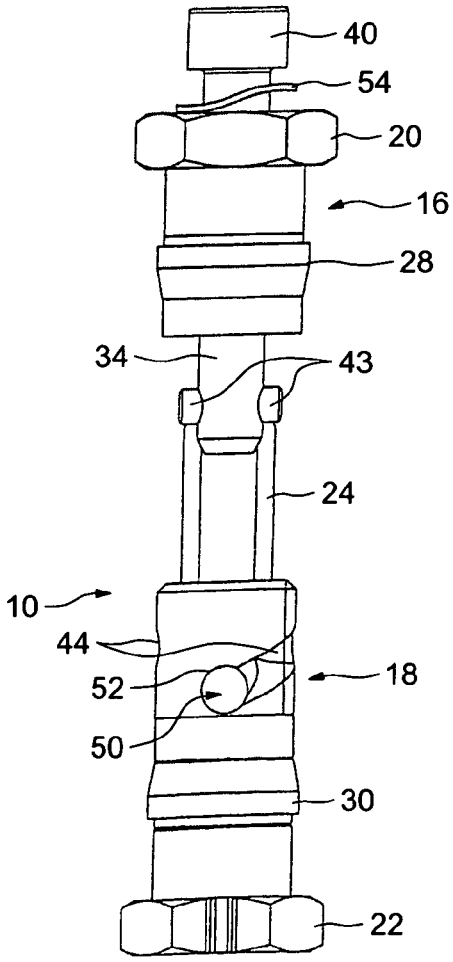
FIG.3
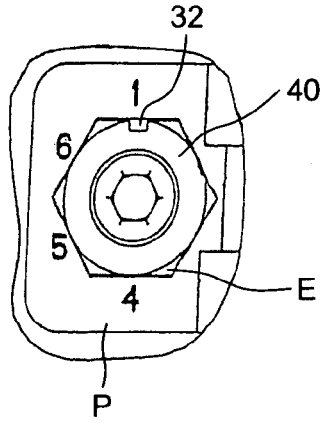

FIXING DEVICE FOR TWO-PART CONNECTOR AND CORRESPONDING TWO-PART CONNECTOR

The invention relates to connectors and more particularly to a fixing device for two-part connectors.

Two-part connectors are conventionally used for the electrical connection of bundles of cables to be connected. They are generally used in vehicles, in particular in aircraft, to supply power to onboard electrical or electronic equipment or for the exchange of data between onboard electrical or electronic units.

Connectors of this type generally comprise two matching connector parts which fix together. Each connector part comprises a moulded material insulative body incorporating contacts, respectively male and female, for mechanical fixing and for electrical connection of terminals fitted to the ends of the conductors to be connected. A screening casing surrounds the insulative body of each connector part.

Clearly, each conductor of a bundle to be connected must be connected to a corresponding conductor of another bundle. To ensure correct connection of the conductors, the connectors are often provided with polarizer means so that the connector parts can be assembled in only one predefined position.

In this regard, see French patent application No. 2 849 967, in which two connector parts are assembled by means of a fixing device that comprises polarizer means and nut-and-bolt fixing means. In the fixing device described in the above document, the polarizer means are incorporated into the fixing means. However, fixing as such of the two connector parts is relatively time-consuming and cannot reliably produce perfect and identically reproducible fixing of the two connector parts.

The object of the invention is therefore to alleviate the drawbacks of prior art connector fixing devices and in particular to speed up assembling and fixing the two connector parts without increasing the number of components of the fixing devices.

The invention therefore consists in a fixing device for two-part connectors for connecting electrical conductors, the device comprising first and second bushes adapted to be mounted in respective bores in the two connector parts, the first and second bushes comprising complementary means for removably fixing the first bush to the second bush, including polarizer means for authorizing cooperation of the fixing means in only one predetermined angular position of the first and second bushes.

According to one general feature of the above fixing device, the removable fixing means are quarter-turn fixing means.

The fixing as such of the two connector parts is therefore particularly quick. Furthermore, the polarizer means remain integrated into the fixing means, so that fast assembly is achieved without increasing the number of components of the fixing device and the connector, and therefore without unacceptably increasing manufacturing costs.

According to another feature of the invention, the polarizer means include a male polarizer in the form of a tooth projecting from one of the bushes and a female polarizer in the form of a complementary housing in the other bush in which said tooth engages.

According to a further feature of the invention, each bush has a polygonal head and a generally cylindrical portion extending from said head and provided with means for fastening the bush into one of the connector parts.

The head is advantageously hexagonal and adapted to be inserted into a housing of complementary shape in the corresponding connector part.

In one embodiment, the means for fixing the first bush to the second bush include a rod adapted to be inserted in an axial passage in the first bush and provided adapted to be with a pair of radial end pins and two complementary generally helicoidal grooves in the wall of the second bush.

The grooves preferably each comprise upstream and downstream end portions for receiving the pins.

The upstream end portion opens into a rectilinear axial groove for insertion of the rod into the second bush and the downstream end portion includes a housing adapted to constitute a stable locking position of the first and second bushes.

The fixing means may further include a head from which the rod extends.

An elastically deformable member may then be placed between the head and the corresponding bush to urge the pins into the housing of the downstream end portion.

A second aspect of the invention consists in a two-part connector for electrical conductors characterized in that it comprises a pair of fixing devices as defined above for fixing the two connector parts together.

Other objects, features and advantages of the invention will become apparent on reading the following description, which is given by way of nonlimiting example only and with reference to the appended drawings, in which:

FIG. 1 is a perspective view of a fixing device of the invention at the start of assembly;

FIG. 2 is a side view of the FIG. 1 device on the plane II-II;

FIG. 3 is a plan view of the fixing device;

Figure 4:
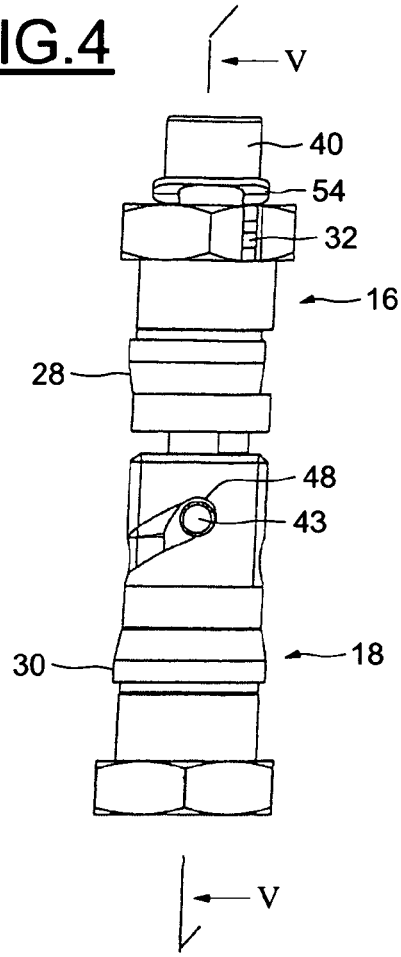
FIG. 4 is a side view of the fixing device during assembly.

The invention relates directly only to the fixing device, the connector itself consisting of a conventional two-part connector; for this reason, FIGS. 1 to 6 show only the fixing device.

In particular, FIG. 1 is a perspective view of a fixing device 10 of the invention.

It is designed to fix together two conventional connector parts for connecting conductors of two bundles of conductors to be connected, in particular in aeronautical applications, to supply power to onboard electrical or electronic units or for the exchange of data between such units.

Connectors of this type have two matching connector parts each designed to provide mechanical fixing and electrical connection of a bundle of conductors and to establish an electrical connection between conductors to be connected that are connected to the respective connector parts. The connector parts are fixed together by end lugs in each of which a fixing device 10 is mounted.

As seen in FIG. 1, each device 10 includes two bushes 12 and 14 which are inserted into bores in the facing two end lugs of the respective two connector parts to be assembled.

Each bush has a generally cylindrical portion 16 and 18 and a polygonal head 20 and 22 at the end, from which head the cylindrical portion extends. The diameters of the cylindrical portions are identical. The heads at the ends advantageously have identical external shapes.

Each of the cylindrical portions 16 and 18 takes the form of a hollow cylinder. However, one bush 12 constitutes a female bush and the other bush 14 constitutes a male bush.

The bush 14 has, at its end opposite the head 22, a radially offset tooth 24 projecting parallel to the general axis of the bush. To enable it to be inserted inside the other bush, this tooth takes the form of a portion of a cylinder of smaller diameter than the remainder of the bush.

As seen in FIGS. 1 and 2, the free end region of the female bush 12 is to this end provided with a housing 26 that is of complementary shape to the tooth 24 and opens into an internal bore of the bush. To allow insertion of the male bush 14 into the female bush 12 in only one predetermined angular position, the housing 26 subtends inside the bush 14 only a predetermined angular sector corresponding to that of the tooth 24.

As indicated above, the bushes 12 and 14 are designed to be inserted into facing end lugs of the two connectors parts to be assembled. To this end, the end lugs are each provided with a staggered bore, for example. The bushes are then each provided with an elastically deformable ring 28 and 30, for example a separate ring, the thickness of which is increased to delimit a ramp for clipping the lug into the bore of the corresponding end lug.

Referring also to FIG. 3, to allow insertion of the bushes in only one angular position, the end lugs P also comprise an imprint E of complementary shape to the heads 20 and 22.

The heads 20 and 22 are preferably hexagonal. It is therefore possible to insert the bushes into the end lugs in six different angular positions. As seen in FIG. 3, the heads are preferably provided with an identifying notch 32 and a number is associated with each flat of the imprint E formed in an end lug P to enable identification and marking of the intended angular position of the bush.

Referring again to FIGS. 1 and 2, the fixing device is further provided with complementary means for removably fixing the male bush 14 to the female bush 12.

The fixing device includes a rod 34 that is inserted into an opening 36 in the cylindrical portion 16 of the female bush 12 through an orifice 38 in the hexagonal head 20.

The rod 34 has at one end a head 40 with an imprint 42, for example a hexagonal imprint, shaped to receive an appropriate tool, for example an Allen key, and at its opposite end radial pins 43 which are inserted into two complementary helicoidal grooves 44 in the male bush 14 when fixing the bushes.

The grooves 44 subtend an angular sector of approximately 90°. The fixing means therefore constitute quarter-turn fixing means.

Figure 5:
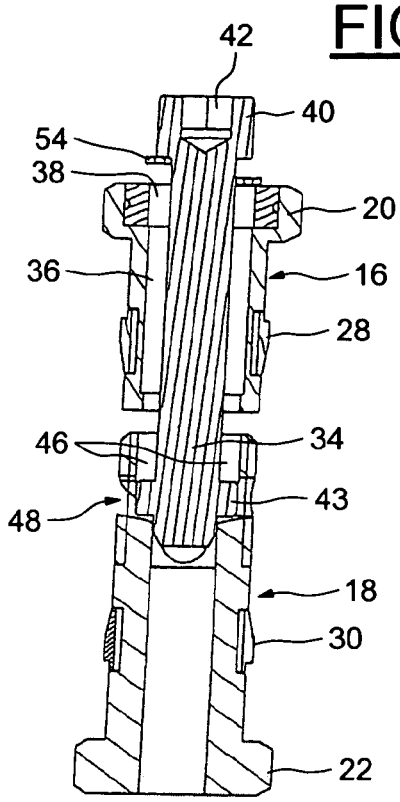
FIG. 5 is a view of the device in section taken along the line V-V in FIG. 4.
Figure 6:
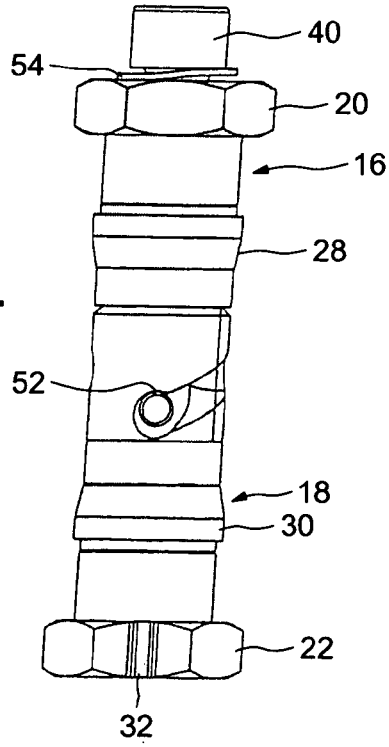
FIG. 6 is a side view of the fixing device of the invention after fixing the two connector parts.

Referring to FIGS. 4 to 6, after inserting the male bush into the female bush 14, it is merely necessary to rotate the rod 34 relative to the male bush 12 to move the pins 43 into the helicoidal grooves 44 to clamp the connectors one against the other.

Note that the length of the rod 34, and in particular the position of the pins 43 at the end relative to the grooves 44, are selected to prevent insertion of the pins into the grooves unless the bushes are in their respective correct angular positions.

Note, however, that during insertion of the male bush into the female bush, the pins 43 are inserted into two rectilinear axial grooves 46 that open at one end at the free end of the male bush 14 and at the other end into the respective helicoidal bushes 44.

Referring finally to FIGS. 2, 4 and 5, the helicoidal grooves 44 have, referred to the direction of introduction of the rod 34 into the male bush 14, upstream and downstream end portions 48 and 50 designed to receive the pins of the fixing device, respectively at the beginning and end of clamping.

The upstream end 48 of each groove 44 communicates with a corresponding rectilinear groove 46.

The downstream end forms a housing provided with a cut-out 52 delimiting a seat for receiving a pin 43 of the rod 34 into which the pin is urged by an elastically deformable member 54 consisting of a corrugated or Belleville spring washer between the head 40 of the rod 34 and the hexagonal head 20 of the female bush 12.

Clearly, the operation of fixing two connector parts to be assembled by means of the fixing device that has just been described is particularly quick and achieves an effective and reliable assembly without it being necessary to increase the number of components of the fixing device.

To assemble the connector parts, it is merely necessary to insert the male and female bushes into the bores in the end lugs of the connector parts in the respective angular positions identified by means of the notch in the heads 20 and 22 and the numbers indicated on the connectors. In this rest position, the radial pins 43 of the rod 34 are indexed relative to the housing 26, enabling easy assembly in the rectilinear grooves 46 of the bush 14. The connector parts are then assembled together until the end pins 43 are inserted into the respective upstream ends 48 of the grooves. The fixing device is then in the position represented in FIGS. 4 and 5. The bushes are then clamped and locked by rotating the rod 34 through a quarter-turn until the pins locate in the downstream housings. In this position, visible in FIG. 6, the compressed spring 54 urges the pins against the seat 52, so that the resulting assembly cannot be released without external action.

The invention claimed is:

1. Fixing device for two-part connectors for connecting electrical conductors, the device comprising a first bush and a second bush adapted to be mounted in respective bores in the two connector parts, the first and second bushes comprising complementary means for removably fixing the first bush to the second bush, including polarizer means for authorizing cooperation of the fixing means in only one predetermined angular position of the first and second bushes, wherein the removable fixing means are quarter-turn fixing means.

2. Device according to claim 1, wherein the polarizer means include a male polarizer in the form of a tooth projecting from one of the bushes and a female polarizer in the form of a complementary housing in the other bush in which said tooth engages.

3. Device according to claim 1, wherein each bush has a polygonal head and a cylindrical portion extending from said head and provided with means for fastening the bush into one of the connector parts.

4. Device according to claim 3, wherein the head is hexagonal and is adapted to be inserted into a complementary housing in the corresponding connector part.

5. Device according to claim 1, wherein the means for fixing the first bush to the second bush comprises a rod adapted to be inserted in an axial passage in the first bush and provided with a pair of radial end pins and two complementary generally helicoidal grooves in the wall of the second bush.

6. Device according to claim 5, wherein the grooves each comprise upstream and downstream end portions for receiving the pins, the upstream end portion opening into a rectilinear axial groove for insertion of the rod into the second bush and the downstream end portion comprising a housing adapted to constitute a stable locking position of the first and second bushes.

7. Device according to claim 5 wherein the fixing means further comprises a head from which the rod extends.

8. Device according to claim 7, wherein the fixing means further comprises an elastically deformable member between the head and the corresponding bush to urge the pins into the housing of the downstream end portion.

9. Two-part connector for electrical conductors, comprising a pair of fixing devices for fixing the two connector parts to each other, each fixing device comprising a first bush and a second bush adapted to be mounted in respective bores in the two connector parts, the first and second bushes comprising complementary means for removably fixing the first bush to the second bush, including polarizer means for authorizing cooperation of the fixing means in only one predetermined angular position of the first and second bushes, wherein the removable fixing means are quarter-turn fixing means.

10. Connector according to claim 9, wherein the polarizer means include a male polarizer in the form of a tooth projecting from one of the bushes and a female polarizer in the form of a complementary housing in the other bush in which said tooth engages.

11. Connector according to claim 9, wherein each bush has a polygonal head and a cylindrical portion extending from said head and provided with means for fastening the bush into one of the connector parts.

12. Connector according to claim 11, wherein the head is hexagonal and is adapted to be inserted into a complementary housing in the corresponding connector part.

13. Connector according to claim 9, wherein the means for fixing the first bush to the second bush comprises a rod adapted to be inserted in an axial passage in the first bush and provided with a pair of radial end pins and two complementary generally helicoidal grooves in the wall of the second bush.

14. Connector according to claim 13, wherein the grooves each comprise upstream and downstream end portions for receiving the pins, the upstream end portion opening into a rectilinear axial groove for insertion of the rod into the second bush and the downstream end portion comprising a housing adapted to constitute a stable locking position of the first and second bushes.

15. Connector according to claim 13, wherein the fixing means further comprises a head from which the rod extends.

16. Connector according to claim 15, wherein the fixing means further comprises an elastically deformable member between the head and the corresponding bush to urge the pins into the housing of the downstream end portion.

* * * * *